US008151388B2

(12) United States Patent
West, III

(10) Patent No.: US 8,151,388 B2
(45) Date of Patent: Apr. 10, 2012

(54) PATIENT TRANSPORT DEVICES AND METHODS FOR SECURING PATIENTS THERETO WITH RESTRAINT ARMS

(75) Inventor: James C. West, III, Blanchester, OH (US)

(73) Assignee: Ferno-Washington, Inc., Wilmington, OH (US)

( * ) Notice: Subject to any disclaimer, the term of this patent is extended or adjusted under 35 U.S.C. 154(b) by 0 days.

(21) Appl. No.: 12/921,918

(22) PCT Filed: Mar. 11, 2009

(86) PCT No.: PCT/US2009/036754

§ 371 (c)(1),
(2), (4) Date: Dec. 10, 2010

(87) PCT Pub. No.: WO2009/114593

PCT Pub. Date: Sep. 17, 2009

(65) Prior Publication Data

US 2011/0101718 A1 May 5, 2011

(51) Int. Cl.
*A47B 7/00* (2006.01)

(52) U.S. Cl. ..... 5/621; 5/622; 5/623; 5/647; 5/86.1; 5/643; 296/20

(58) Field of Classification Search ..... 5/86.1, 5/621, 622, 84.1, 110, 425, 637, 347, 650, 5/643, 625, 628; 269/328, 20
See application file for complete search history.

(56) References Cited

U.S. PATENT DOCUMENTS

| | | | | | |
|---|---|---|---|---|---|
| RE24,377 | E * | 10/1957 | Creelman | 5/603 |
| 4,506,664 | A * | 3/1985 | Brault | 5/628 |
| 4,655,206 | A * | 4/1987 | Moody | 5/628 |
| 4,779,858 | A * | 10/1988 | Saussereau | 5/601 |
| 6,067,678 | A * | 5/2000 | Trevino | 5/628 |
| 6,966,087 | B2 * | 11/2005 | Robinette | 5/625 |
| 2004/0011779 | A1 * | 1/2004 | Krywiczanin et al. | 219/217 |
| 2004/0049852 | A1 * | 3/2004 | Phillips et al. | 5/626 |
| 2004/0128767 | A1 * | 7/2004 | Hood | 5/628 |
| 2005/0241068 | A1 * | 11/2005 | Tomcany et al. | 5/622 |

* cited by examiner

*Primary Examiner* — Robert G Santos
*Assistant Examiner* — Brittany Wilson
(74) *Attorney, Agent, or Firm* — Dinsmore & Shohl LLP

(57) ABSTRACT

A patient transport device for transporting a patient secured to a secured area thereof may include a first restraint arm disposed about a first longitudinal side of the secured area and a second restraint arm disposed about a second longitudinal side of the secured area opposite the first longitudinal side of the secured area. A head-cage restraint arm may further be disposed about a third leading end of the secured area between the first and second longitudinal sides of the secured area. The first restraint arm, the second restraint arm and the head-cage restraint arm may be operable to transition between an open configuration and a restrained configuration relative to the secured area.

19 Claims, 2 Drawing Sheets

PATIENT TRANSPORT DEVICES AND METHODS FOR SECURING PATIENTS THERETO WITH RESTRAINT ARMS

The present invention relates to patient transport devices, and more particularly, to patient transport devices and methods for securing patients thereto with restraint arms.

Providing effective restraints for a patient situated in an emergency vehicle such as, for example, an ambulance on an emergency cot is a complex problem with many unique and unresolved issues. As the ambulance environment is specifically designed for emergency treatment of passengers, exposure in a crash environment may be more severe to a patient requiring transport. When transporting a patient with an acute medical problem that requires constant monitoring, a current practice is to restrain the patient directly to the cot with chest and hip belts. However, such a practice provides virtually no crash restraint in the forward direction. In addition, the chest and hip belts need to be fitted to each and every patient to ensure a secure fit which is time consuming. Also, if such a fitting is not done properly, re-adjustment from time to time may be needed. Further, removal and/or repositioning of the belts may be needed if obstructing a critical area of the patient, which again is time consuming.

It is against the above background that the present invention provides an emergency cot with restraint arms providing crash restraint, especially in the forward direction.

In one embodiment, a patient support for transporting a patient secured to a secured area thereof may include a first rigid restraint arm disposed about a first longitudinal side of the secured area and a second rigid restraint arm disposed about a second longitudinal side of the secured area opposite the first longitudinal side of the secured area. A rigid head-cage restraint arm may further be disposed about a third leading end of the secured area between the first and second longitudinal sides of the secured area. The first restraint arm, the second restraint arm and the head-cage restraint arm may be operable to transition between an open configuration and a restrained configuration relative to the secured area.

In another embodiment, a cot with restraint arms for restraining a patient to the cot may include a patient support connected to a cot frame comprising a first longitudinal side frame member opposing a second longitudinal side frame member, wherein the first and second longitudinal side frame members are connected by a leading end frame member and a trailing end member. A first restraint arm may be rotatably connected to the first longitudinal side frame member. A second restraint arm may be rotatably connected to the second longitudinal side frame member. And, a head-cage restraint arm may be rotatably connected to the leading end frame member, wherein the first restraint arm, the second restraint arm and the head-cage restraint arm may be operable to transition between an open configuration and a restrained configuration relative to the patient support.

In yet another embodiment, a method of restraining a patient in a cot may include placing rigid restraint arms in an open configuration allowing access to a patient support disposed about the cot, placing the patient onto the patient support, and moving the restraint arms into a restrained configuration such that the patient becomes restrained in at least the lateral directions and a forward direction relative to the patient support.

These and other features and advantages of the invention will be more fully understood from the following description of the various embodiments of the invention taken together with the accompanying drawing.

The organization and manner of operation of the invention, together with further objects and advantages thereof, may best be understood by reference to the following description taken in connection with the accompanying drawing in which:

FIG. 1 is a side elevation view of an emergency cot provided with restraint arms according to the present invention.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiment(s) of the present invention.

While the invention may be susceptible to embodiment in different forms, there is shown in the drawing, and herein will be described in detail, specific embodiments with the understanding that the present disclosure is to be considered an exemplification of the principles of the invention, and is not intended to limit the invention to that as illustrated and described herein.

BRIEF DESCRIPTION OF THE DRAWINGS

Referring to FIG. 1, illustrated is an emergency cot embodiment provided with restraint arms according to the present invention. The cot is indicated generally by symbol 10, and has a wheeled undercarriage 12. The undercarriage 12 may comprise a first longitudinal side frame member 14 on a first longitudinal side and an opposing second longitudinal side frame member 16 on a second longitudinal side. The two longitudinal side frame members 14,16 are interconnected by a leading end frame member 21 at a leading end 18 and a trailing end frame member 22 at a trailing end 20 of cot 10. The undercarriage 12 and its frame members 14,16,21,22 may comprise a metal, alloy, composite, plastic or any other material capable of supporting a load of a patient. In one embodiment, the undercarriage 12 may comprise hollow metal tubes.

Figure 1:
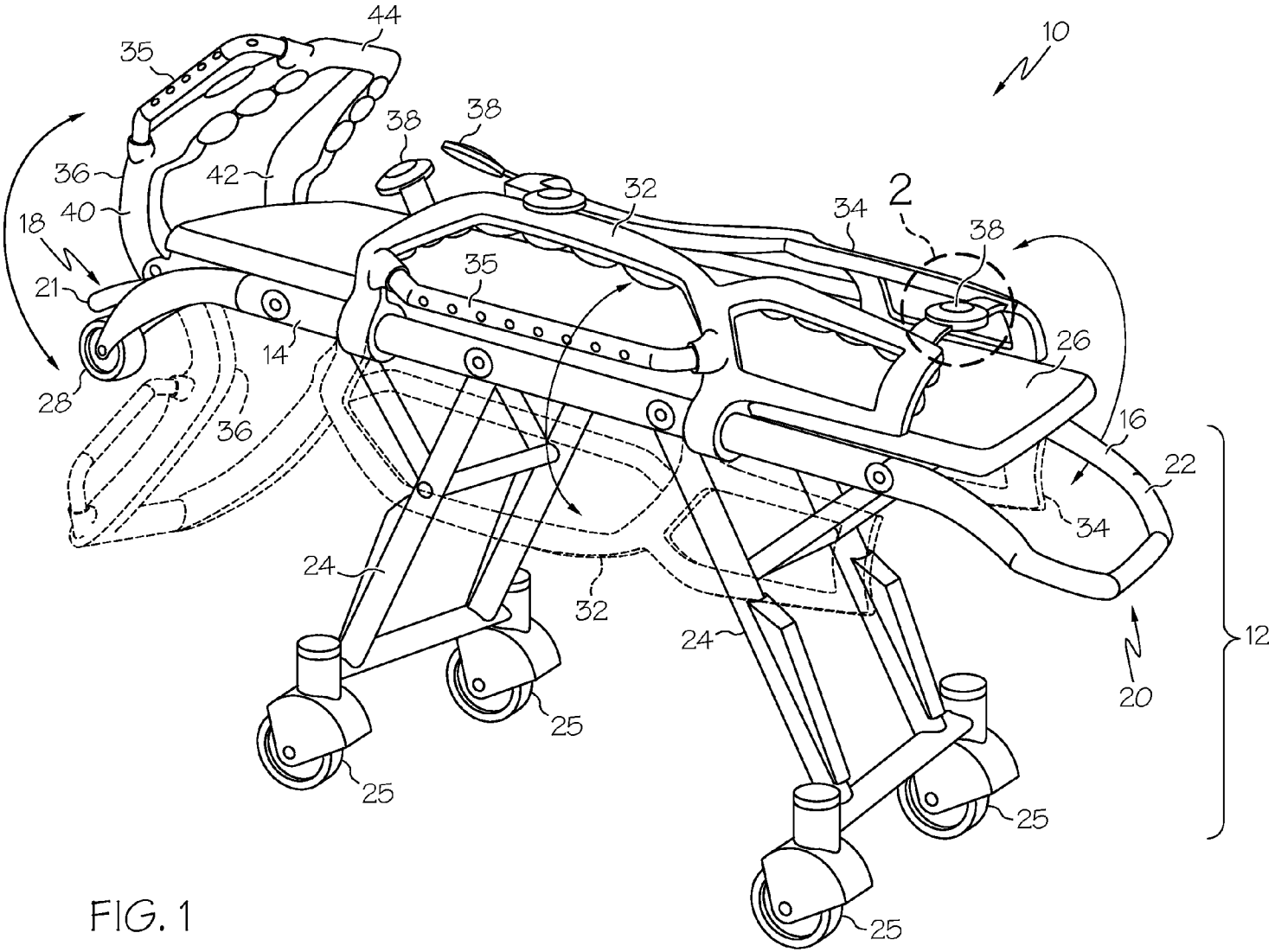
FIG. 1 illustrates an emergency cot embodiment as described herein.

The cot 10 may further comprise legs 24 about the undercarriage 12. The legs 24 may comprise wheels, tires, rollers, or any other device that may aid in the transport of the cot 10. The legs may be secured to the first and second longitudinal side frame members 14,16 via bolts, screws, welds or any other alternative operable connection. In one embodiment (as illustrated), the legs 24 may rotate in the longitudinal direction (i.e., the direction extending from the leading end 18 to the trailing end 20 and vice versa) relative to the first and second longitudinal side frame members 14,16 upon loading and unloading from an emergency vehicle such as an ambulance. In another embodiment, any other transitioning style of legs may be used which situates the legs 24 folded or collapsed in close proximity to the first and second longitudinal side frame members 14,16, including, but not limited to, an X-frame or scissor type of moving legs or telescopic legs.

In one embodiment, loading wheels 28 may also be provided about the leading end 18 of the cot 10. The loading wheels 28 may be powered or un-powered and may assist in the loading or unloading of a cot from an emergency vehicle. For example, when loading the cot 10, the leading end 18 may enter the emergency vehicle, such as e.g. an ambulance bay, such that the loading wheels 28 begin to travel across the floor of the ambulance bay. As the cot 10 rolls further into the ambulance, the legs 24 may collapse into the undercarriage 12 such that the cot 10 may lay flat within the ambulance and being supported also on wheels 25 now situated in close proximity or adjacent the first and second longitudinal side frame members 14,16. In the reverse, a cot 10 may be unloaded from an ambulance such that the loading wheels 28 partially support the cot 10 as the legs 24 extend from their contracted position to their fully upright position as is shown by FIG. 1.

The cot 10 may further comprise a patient support 26. In one embodiment, as shown in FIG. 1, the patient support 26 may be supported about the first longitudinal side frame member 14 and the second longitudinal side frame member 16. In another embodiment, the patient support 26 may alternatively be supported by the leading end member 21 and the trailing end member 20. In yet another embodiment, the patient support 26 may be supported by all four support members. The patient support 26 may comprise a mattress-type bed as shown in FIG. 1. However, it is further to be appreciated that the patient support 26 may be of any type, such as providing repositionable back and leg rests, non-removable or removable with separate rollers, and the like. For example, in a removable embodiment, the patient support 26 may further comprise frame members 14,16,21,22 and be separable from a trolley support frame (not shown, but which rotatably support the legs 24) of the undercarriage 12 upon release of a locking device connecting the patient support 26 thereto.

As seen in FIG. 1, the cot 10 may further comprise rigid restraint arms for restraining a patient to a secured area about the patient support 26. The secured area may generally comprise the space in which a patient would be disposed when placed onto the patient support 26 of the cot 10. For example, in one embodiment, the rigid restraint arms may enclose and retain a patient in the secure area defined from above a patient's shoulders to below the patient's knees when situated on the patient support 26. As shown, the rigid restraint arms comprises a first restraint arm 32, a second restraint arm 34 and a head-cage restraint arm 36. The first restraint arm 32 may be rotatably connected to the cot 10 about the first longitudinal side frame member 14 while the second restraint arm 32 may be rotatably connected to the cot 10 about the second longitudinal side frame member 16. Both the first restraint arm 32 and the second restraint arm 34 may rotate independently about their respective longitudinal side frame members 14,16 to provide rotational freedom in the range of about 180° to about 270°, e.g., from about a vertically-down position which situates each restraint arm in close proximity to a respective side of legs 24, to a position in which the first restraint arm 32 and second restraint arm 34 are touching the patient support 26.

The first restraint arm 32 and second restraint arm 34 as well as the head-cage restraint arm 36 may comprise a material similar to that of the undercarriage 12 as discussed above, or in the alternative, may comprise a separate material such as a foam, rubber or other material that may provide greater comfort to a patient. Furthermore, the first and second restraint arms 32, 34 as well as the head-cage restraint arm 36 may be structurally reinforced and provide additional lifting surfaces 35 such that two or more attendants may use the restraint arms 32,34,36 as a lifting surface when positioned closely and secured horizontally about the patient support 26. Such a lifting configuration may be useful in situations when handling a person of an extreme amount of weight (i.e., greater than 300 lbs). Further, the supporting configuration may be useful if necessary to hang emergency equipment/medical devices, and/or personal belongings of the victim. In another embodiment, the interior surfaces of the restraint arms 32,34,36 intended to contact the patient may comprise padding, felt, rubber or any other material that may provide additional comfort or support to the patient.

In one embodiment, the first and second restraint arms 32,34 may each comprise a length of about ⅔ the length of the patient support 26. Furthermore, the first and second restraint arms 32,34 may be relatively biased towards the trailing end 20 off the patient support 26 such that the first and second restraint arms 32,34 may be configured to restrain the lower portion of a patient (i.e. the legs and stomach). In another embodiment, the first restraint arm and second restraint arm 32,34 may each be independently adjustable in their length, height and/or position about the patient support 26. For example, the first and second restraint arms 32,34 may be telescopic in their height and length such that each dimension may be independently adjusted. Furthermore, tracks may be provided about the lengths of the first and second longitudinal side frame members 14,16 for sliding the first and second restraint arms 32,34. In the alternative, the rotatable connection between the first and second restraint arms 32,34 and the first and second longitudinal side frame members 14,16 may be releasable such that the position, or even of the presence, of the first and second restraint arms 32,34 may be independently adjusted. Such embodiments may provide greater flexibility in restraining a patient to the secured area while considering the patient's unique physical condition as well be discussed herein.

When a patient is situated on the patient support 26, the first restraint arm 32 and second restraint arm 35 may be transitioned from an open configuration to a restrained configuration (as illustrated by FIG. 1) to enclose and/or surround the sides of the patient to provide restraint in the lateral directions (i.e. the side-to-side direction traversing the patient support between the first restraint arm 32 and the second restraint arm 34). The first restraint arm 32 and second restraint arm 34 may further be operable to enclose and/or surround the chest of the patient (if patient is in such a condition to permit) to provide restraint in the vertical direction (i.e. to prevent the patient from rising up off of the patient support 26). In one embodiment, the rotational freedom of the first and second restraint arms 32,34 may be such that they may rotate over the patient in the patient support 26. In another embodiment, the first restraint arm 32 and second restraint arm 34 may have a bent or curved geometry such that the first and second restraint arms 32,34 are concave about the patient support. For example, the first and second restraint arms 32,34 may have hinges about their heights such that top portions of the restraint arms may rotate over the patient while bottom portions may stay in a relatively vertical orientation. In yet another embodiment, the first restraint arm 32 and second restraint arm 34 may utilize a combination of rotational freedom and geometry to provide lateral and vertical restraint about the secured area.

Figure 2:
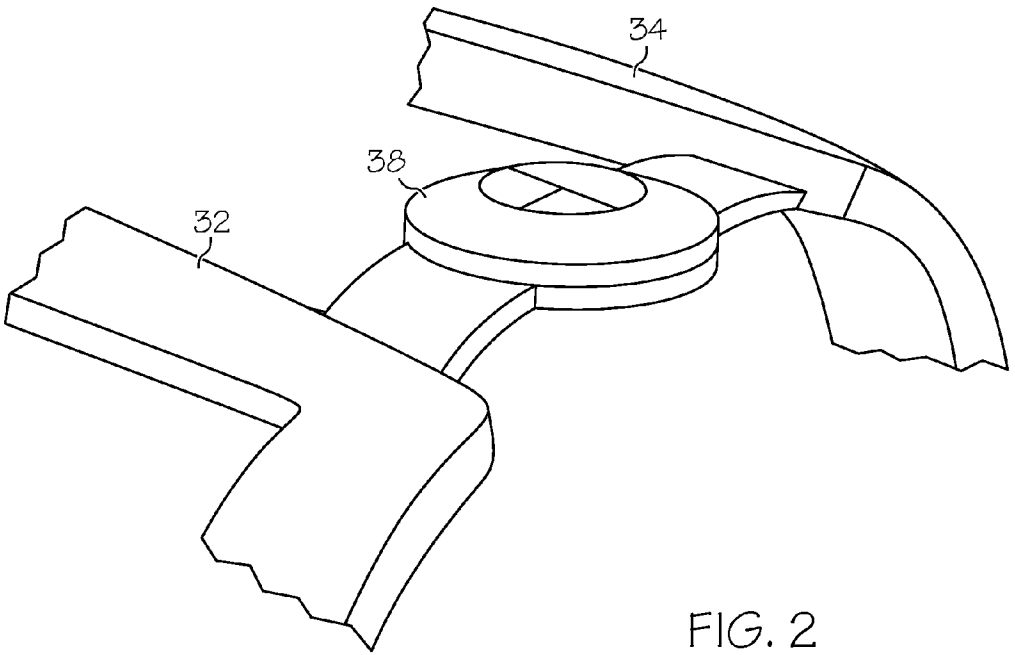
FIG. 2 illustrates an expanded view of the releasable lock 2 of the emergency cot embodiment of FIG. 1.

A restraint arm lock with a release may also be provided to the first and second restraint arms 32, 24 which when a technician releases, the respective restraint arm is free to rotate to be repositioned. A releasable lock 2 is depicted as one example of a connecting device 38 in FIG. 1, and the releasable lock 2 is shown in an expanded view in FIG. 2. In one embodiment, each lock may provide a plurality of positions, and in another embodiment, may provide an infinite number of positions for the first and second restraint arms 32, 34 to be secured in a relative position to the respective longitudinal side frame members 14, 16.

As shown, the head-cage restraint arm 36 is provided rotatably mounted at the leading end 18 of the cot 10. The head-cage restraint arm 36 may comprise a first shoulder arm 40 and a second shoulder arm 42 connected by a chest arm 44. Similar to the first and second restraint arms 32,34, the first shoulder arm 40 and second should arm 42 may be operable to rotate from a substantially down or open configuration to a substantially up or restrained configuration by passing over a patient's shoulders. The head-cage restraint arm 36 may comprise materials similar to those of the first and second restraint arms 32,34 as discussed previously above and may similarly comprise padding, felt, rubber or other material about its inner surface.

A head opening may be defined by the opening between the first should arm 40, second should arm 42 and chest arm 44 and may provide adequate space for the patients head to pass through. The first and second shoulder arms 40, 42 may comprise a length such that when the head-cage restraint arm 36 is in the restrained configuration, the chest arm 44 is substantially disposed about a patient's chest. In the alternative, the first and second shoulder arms 40, 42 may comprise an adjustable length such that the chest arm 44 may be disposed relative the patients body as desired.

In one embodiment, as shown in FIG. 1, the first shoulder arm 40, second shoulder arm 42 and chest arm 44 may be connected such that the entire head-cage restraint arm 36 rotates in unison. In another embodiment (not shown) the head-cage restraint arm 36 may lack a chest arm 44 such that the first shoulder arm 40 and second should arm 42 may independently rotate between an open configuration and a restrained configuration which may allow for selective access to areas of the patient through the employment of a single shoulder arm 40 or 42 in the restrained configuration. Furthermore, in such an embodiment, the distance separating the first shoulder arm 40 and the second shoulder arm 42 may be adjustable to accommodate for patient heads of different widths. For example, the first shoulder arm 40 and the second should arm 42 may be connected to the cot 10 about a track such that the shoulder arms 40, 42 may be adjusted in the lateral directions.

As mentioned above, the head-cage restraint arm 36 may also be rotatably mounted at or adjacent the leading end 18 of the cot 10. The head-cage restraint arm 36, like the first restraint arm 32 and the second restraint arm 34, may have a rotational freedom in the range of about 180° to about 270°, e.g., from about a vertically-down position to a position in which the head-cage restraint arm 36 is touching the patient support 26. When a patient is situated on the patient support 26, the head-cage restraint arm 36 may transition to the restrained position to enclose and/or hug the shoulders and chest of a patient (if the patient is in such a condition to permit). A head-cage restraint arm 36 in the restrained configuration may provide restraint in at least a forward direction (e.g. where the patient would slide forward such that his head would leave the patient support 26 before his body). Where the head-cage restraint arm 36 comes over the patient's body, the head-cage restraint arm 36 may also restrain the patient in a vertical direction. Furthermore, a lock similar to that of the first restraint arm 32 and second restraint arm 34 as discussed above may also be provided to secure the head cage restraint arm 36 in one of a number of positions relative to the patient support 26.

Connecting devices 38 may also be disposed about any combination of the first restraint arm 32, second restraint arm 34 and/or head-cage restraint arm 36. Connecting devices 38 may be operable to connect two or more of the restraint arms 32,34,36 to one another when the restraint arms 32,34,36 are in the restrained configuration. For example, in one embodiment, connecting devices 38 may comprise belt clips operable to come across and over the top of a patient on the patient support 26. In such an embodiment, connecting devices 38 may thereby further secure the patient to the patient support 26 in the event of a crash.

Thus, in operation, an operator may transition the first restraint arm 32, the second restraint arm 34 and the head-cage restraint arm 36 between an open configuration and a restrained configuration relative to the secured area. When in the open configuration, the first restraint arm 32, second restraint arm 34 and head-cage restraint arm 36 may be in a substantially downward direction. Such a configuration may provide for greater access to the patient support 26 so that a patient may be loaded or unloaded from the cot 10. The first restraint arm 32, second restraint arm 34 and head-cage restraint arm 36 may then be transitioned (e.g. rotated) into the restrained configuration such that the restraint arms 32,34, 36 are in a substantially upward position. In such a configuration, the patient may be restrained in the secured area (or the area in which the patient is disposed about the patient support 26) in at least the lateral directions by the first and second restraint arms 32,34 and in the forward direction by the head-cage restraint arm 36. Where all or some of the restraint arms 32,34,36 pass over the patient, the patient may further become restrained in the vertical direction.

The above-described embodiments are intended to illustrate the principles of the invention, not to limit its scope. Other embodiments in variations to these preferred embodiments will be apparent to those skilled in the art and may be made without departing from the spirit and scope of the invention as defined in the following claims. For example, the restraint arms in another embodiment may also operate as cot sidearms and possibly a large body surface to expand the width of the cot. In addition, the present invention is not limited to a cot, as the restraints arm 32, 34, and/or 36 may in other embodiments be provided to an EMT's chair also provided in the ambulance for similar reasons, such as for example, side-to-side and/or chest restraint of the chair's occupant.

The invention claimed is:

1. A patient support for transporting a patient secured to a secured area thereof comprising:

a first rigid restraint arm disposed about a first longitudinal side of the secured area;

a second rigid restraint arm disposed about a second longitudinal side of the secured area opposite the first longitudinal side of the secured area; and, a rigid head-cage restraint arm disposed about a leading end of the secured area between the first and second longitudinal sides of the secured area, wherein the first rigid restraint arm, the second rigid restraint arm and the rigid head-cage restraint arm are operable to transition between an open configuration and a restrained configuration relative to the secured area;

wherein the rigid head-cage restraint arm comprises a first shoulder arm and a second shoulder arm connected by a chest arm defining a head opening there between, and wherein the head-cage restraint is operable to rotate from the open configuration to the restrained configuration over the patient's shoulders such that the patient's head passes through the head opening to dispose the chest arm substantially about the patient's chest.

2. The patient support of claim 1 wherein when in the restrained configuration, the first rigid restraint arm and the second rigid restraint arm restrain the secured area in at least the lateral directions and the rigid head-cage restraint arm restrains the secured area in at least a forward direction.

3. The patient support of claim 2 wherein when in the restrained configuration, the restraint arms further restrain the secured area in a vertical direction.

4. The patient support of claim 1 wherein at least one connecting device is operable to detachably connect the first and second rigid restraint arms when in the restrained configuration.

5. The patient support of claim 1 wherein padding is disposed about inner surfaces of the restraint arms, the inner surfaces facing the secured area when the restraint arms are in the restrained configuration.

6. The patient support of claim 1 being releasably mountable to a wheeled undercarriage.

7. The patient support of claim 1 wherein releasable locks are operable to secure the restraint arms in the restrained configuration.

8. The patient support of claim 1 wherein the support comprises a cot.

9. A cot with restraint arms for restraining a patient to the cot, the emergency cot comprising:

a patient support connected to a cot frame comprising a first longitudinal side frame member opposing a second longitudinal side frame member, wherein the first and second longitudinal side frame members are connected by a leading end frame member and a trailing end frame member;

a first restraint arm rotatably connected to the first longitudinal side frame member;

a second restraint arm rotatably connected to the second longitudinal side frame member; and, a head-cage restraint arm rotatably connected to the leading end frame member, wherein the first restraint arm, the second restraint arm and the head-cage restraint arm are operable to transition between an open configuration and a restrained configuration relative to the patient support;

wherein the rigid head-cage restraint arm comprises a first shoulder arm and a second shoulder arm connected by a chest arm defining a head opening there between; and wherein the head-cage restraint is operable to rotate from the open configuration to the restrained configuration over the patient's shoulders such that the patient's head passes through the head opening to dispose the chest arm substantially about the patient's chest.

10. The cot of claim 9 wherein the patient support comprises a bed.

11. The cot of claim 9 wherein the first restraint arm, second restraint arm and head-cage restraint arm are substantially concave about the patient support when in the restrained configuration.

12. The cot of claim 9 wherein the cot further comprises legs.

13. The cot of claim 9 wherein the first restraint arm, second restraint arm and head-cage restraint arm possess at least 180° of rotational freedom.

14. The cot of claim 9 wherein the first restraint arm, second restraint arm and head-cage restraint arm are structurally reinforced.

15. A method of restraining a patient comprising:

providing a cot comprising a patient support, a first rigid restraint arm, a second rigid restraint arm, and a rigid head-cage restraint arm, wherein each of the first rigid restraint arm, the second rigid restraint arm, and the rigid head-cage restraint arm is capable of being placed in an open configuration and a restrained configuration, wherein the rigid head-cage restraint arm comprises a first shoulder arm and a second shoulder arm connected by a chest arm defining a head opening there between;

placing the rigid restraint arms in the open configuration allowing access to the patient support;

placing the patient onto the patient support;

rotating the head-cage restraint over the patient's shoulders such that the patient's head passes through the head opening to dispose the chest arm substantially about the patient's chest; and moving the rigid restraint arms into the restrained configuration such that the patient becomes restrained in at least a lateral direction and a forward direction relative to the patient support.

16. The method of claim 15 wherein the restrained configuration further restrains the patient in a vertical direction.

17. The method of claim 15 wherein the first rigid restraint arm and the second rigid restraint arm cooperate to restrain the patient in at least the lateral directions, and the rigid head-cage restraint arm restrains the patient in at least the forward direction.

18. The method of claim 15 further comprising engaging a connecting device to detachably connect the first and second rigid restraint arms in the restrained configuration.

19. The method of claim 15 wherein moving the rigid restraint arms into a restrained configuration comprises rotating the rigid restraint arms at least 180.

* * * * *

UNITED STATES PATENT AND TRADEMARK OFFICE

CERTIFICATE OF CORRECTION

PATENT NO. : 8,151,388 B2
APPLICATION NO. : 12/921918
DATED : April 10, 2012
INVENTOR(S) : James C. West It is certified that error appears in the above-identified patent and that said Letters Patent is hereby corrected as shown below:

On the title page insert item [60]:

--Related U.S. Application Data to claim benefit to U.S. Provisional Application Serial No. 61/035,642 filed March 11, 2008.--

Signed and Sealed this
Nineteenth Day of February, 2013

Teresa Stanek Rea
*Acting Director of the United States Patent and Trademark Office*